United States Patent [19]

Loheac

[11] Patent Number: 4,710,597

[45] Date of Patent: Dec. 1, 1987

[54] KEYBOARD FOR THE CONTROL BOX OF AN ELECTRIC APPARATUS

[75] Inventor: Charles Loheac, Auray, France

[73] Assignee: Tabur Caoutchouc, Vannes, France

[21] Appl. No.: 845,140

[22] PCT Filed: Jun. 25, 1985

[86] PCT No.: PCT/FR85/00173

§ 371 Date: Feb. 13, 1986

§ 102(e) Date: Feb. 13, 1986

[87] PCT Pub. No.: WO86/00462

PCT Pub. Date: Jan. 16, 1986

[30] Foreign Application Priority Data

Jun. 26, 1984 [FR] France ..... 84 10056

[51] Int. Cl.[4] ..... H01H 13/70

[52] U.S. Cl. ..... 200/5 A; 200/159 B; 200/314; 200/340; 235/145 R

[58] Field of Search ..... 200/5 A, 159 B, 308, 200/314, 317, 329, 340; 235/145 R

[56] References Cited

U.S. PATENT DOCUMENTS

| | | | |
|---|---|---|---|
| 3,823,309 | 7/1974 | Caruso | 235/145 R |
| 4,066,860 | 1/1978 | Kawasaki | 200/5 A X |
| 4,163,138 | 7/1979 | Harden | 200/5 A X |
| 4,203,013 | 5/1980 | Serras-Paulet | 200/5 A |
| 4,311,893 | 1/1982 | Tsuchiya et al. | 200/5 A X |
| 4,386,245 | 5/1983 | Nimura et al. | 200/5 A X |
| 4,471,189 | 9/1984 | Bacon et al. | 200/159 B |

FOREIGN PATENT DOCUMENTS 0074315 3/1983 European Pat. Off. .

*Primary Examiner*—J. R. Scott

*Attorney, Agent, or Firm*—Sandler & Greenblum

[57] ABSTRACT

Keyboard for the control box (11) of an electric apparatus comprising a sheet (1) which forms a plurality of contactors (2) each projecting from the sheet through a blister (3) which is elastically deformable and which acts as a spring, the contactors (2) being provided with bearing keys (8) and contact pads (5) intended to come into contact with a printed circuit (12) arranged under the sheet (1) of contactors when a pressure is exerted on the keys. This keyboard is remarkable in that at least certain of the contactors (2) are provided with stubs (4) arranged opposite the contact pads (5) and which are intended to be force fitted into corresponding housings provided in the bearing keys (8).

18 Claims, 9 Drawing Figures

KEYBOARD FOR THE CONTROL BOX OF AN ELECTRIC APPARATUS

BACKGROUND OF THE INVENTION

1. Field of the Invention

The invention relates to a keyboard for a control box of an electric apparatus.

2. Description of Pertinent Information

Traditional keyboards for control boxes of electrical apparatuses such as calculators and telephones generally comprise plastic bearing keys provided with metallic contact pads which act on a printed circuit.

The keys of these traditional keyboards are biased in their resting position out of contact with the printed circuit by springs.

As these keyboards evolved, the springs were eliminated by using a sheet of contactors made of non-conducting silicone, each contactor projecting from the sheet through a blister forming a spring. The metallic pads were then advantageously replaced with pads made of conducting silicone.

In these apparatuses, the plastic keys are guided by and rest upon the contactors.

Other types of keyboards were also developed in which the keys are directly molded with the sheet of contactors. In these keyboards the keys are also made of silicone.

Both types of keyboards suffer from disadvantages. One of the disadvantages of the apparatuses in which the keys are separate from the sheet of contactors, resides in the need and difficulty in assembling these separate elements in the box, whereas the keyboards are generally made and delivered separately.

The apparatuses in which the silicone keys are integrally formed with the sheet of contactors have, on the other hand, the disadvantage of reducing disposable space under the sheet.

If to remedy this situation, the interior of the keys are hollowed out to gain space, they then risk not being sufficiently rigid, particularly when the keys are provided with several contact pads.

Finally, it is impossible, with both types of keyboards, to light the keyboard with luminescent diodes without resorting to complicated or cumbersome apparatuses using double printed circuits, for example.

SUMMARY OF THE INVENTION

It is an object of the present invention to solve these problems by separating the bearing keys from the sheet of contactors but in an original way so as to produce a complete keyboard ready for use.

The keyboard according to the invention comprises a sheet which forms a plurality of contactors each projecting from the sheet by means of a blister which is elastically deformable and which acts as a spring. The contactors are also provided with bearing keys and contact pads adapted to come into contact with a printed circuit, arranged under the sheet of contactors, when a pressure is exerted on the keys. This keyboard is remarkable in that at least some of the contactors have stubs arranged opposite from the contact pads which are adapted to be force nested into corresponding housings provided in the bearing keys.

Advantageously, for reasons which will be seen later, the sheet of contactors has projections adapted to rest on the printed circuit in such a manner to create a space between the latter and the sheet of contactors.

In this case, the projections are preferably arranged around displacement axes of the contact pads.

In the embodiment using the separation projections mentioned earlier, the sheet of contactors is traversed by one or several luminescent diodes positioned between the contactors and under or between the keys while the sheet of contactors and the keys have a free space between them and the box in such a manner so as to permit the light of the diodes to be diffused in this space after having been diffused in the space between the printed circuit and the sheet of contactors.

It is within the scope of the invention for the bearing keys to be formed individually or together in any material such as plastic, or any other material.

According to a particularly interesting embodiment the bearing keys are formed from a block in a sheet of keys which covers the sheet of contactors. In this embodiment each key projects from the sheet of keys by means of a supple blister which covers one or several of the elastically deformable blisters of the sheet of contactors.

The sheet of contactors and the sheet of keys are preferably composed of non-conducting silicone whereas the contact pads are composed of conducting silicone.

In the embodiment in which certain keys control several contactors, it can be advantageous for at least some of these keys to each have at least one perforation arranged in the corresponding supple blister of the key so as to allow diffusion of light through this perforation from at least one diode which traverses the sheet of contactors and which is positioned under the key and between the contactors of the latter.

When the keys are formed from a supple material, such as silicone, at least some of these keys can be rendered rigid by plastic reinforcements which are nested in the same stubs of the sheet of contactors as the keys.

Finally, the invention also proposes a procedure for manufacturing a keyboard whose keys are all integral with the same sheet, as mentioned earlier, which is remarkable in that the sheet of contactors is made by molding such that at least some are provided with stubs and the sheet of bearing keys is provided with housings corresponding to the stubs. The method further comprises the step of superposing the two sheets and nesting the stubs of the sheet of contactors by pressure in the corresponding housings of the sheet of keys.

BRIEF DESCRIPTION OF THE DRAWINGS

The invention and its advantages will be clearly understood upon reading the detailed description which follows of an embodiment according to the invention in in conjunction with the attached drawings in which.

DETAILED DESCRIPTION OF PREFERRED EMBODIMENT

Figure 2:
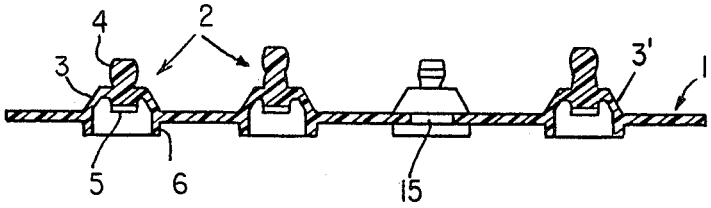
FIGS. 2 and 3 illustrate cross-sectional views taken, respectively, along lines II—II and III—III of FIG. 1.
Figure 3:
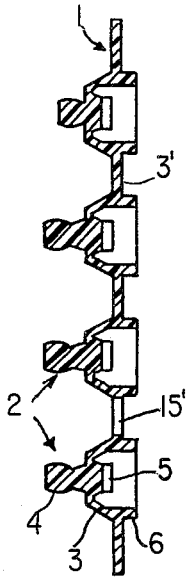
Figure 1:
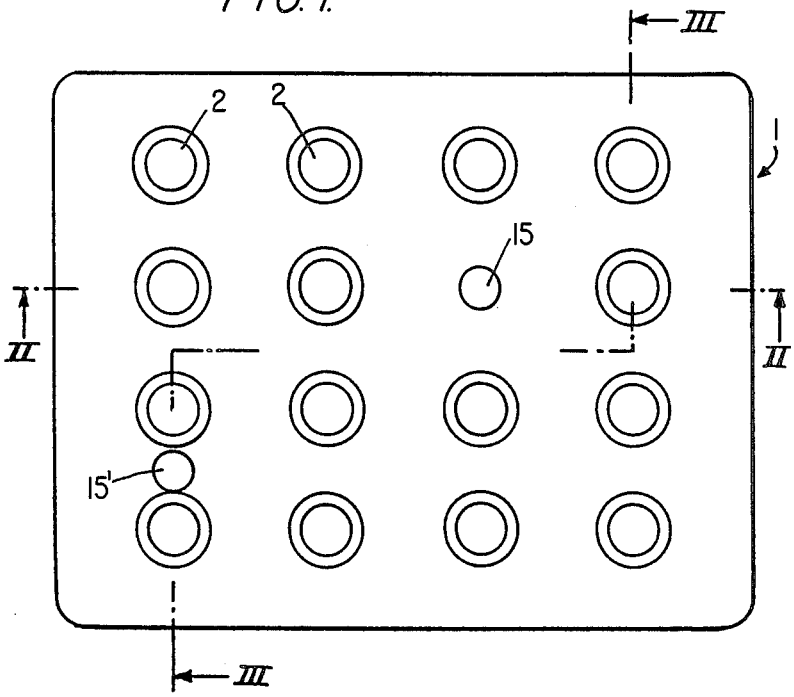
FIG. 1 illustrates a plan view of a sheet of contactors according to the invention.

FIGS. 1, 2 and 3 illustrate a sheet 1 obtained by molding non-conducting silicone comprising a plurality of contactors 2.

Each contactor 2 projects from the sheet 1 through a blister 3 which is supple. Blister 3 elastically deformable and comprises a stub 4 and a contact pad 5 positioned on the opposite which is arranged in the blister 3. Contact pad 5 is made of conducting silicone, for example.

Coaxial to the axes of stubs 4 and pads 5, sheet 1 has annular projections 6 whose function will be discussed later.

Figure 5:
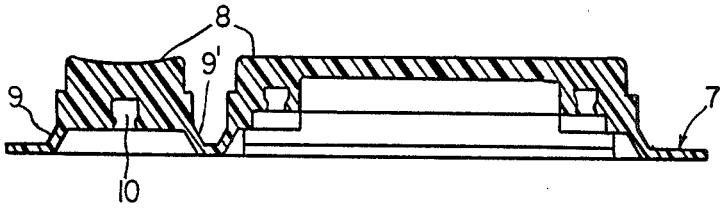
FIGS. 5 and 6 illustrate cross-sectional views taken, respectively, are sections along lines V—V and VI—VI of FIG. 4.
Figure 6:
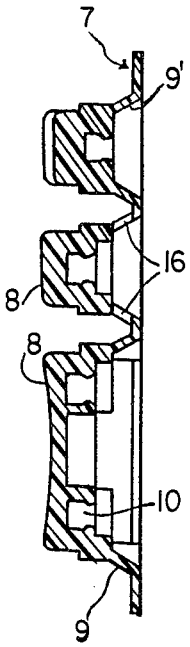
Figure 4:
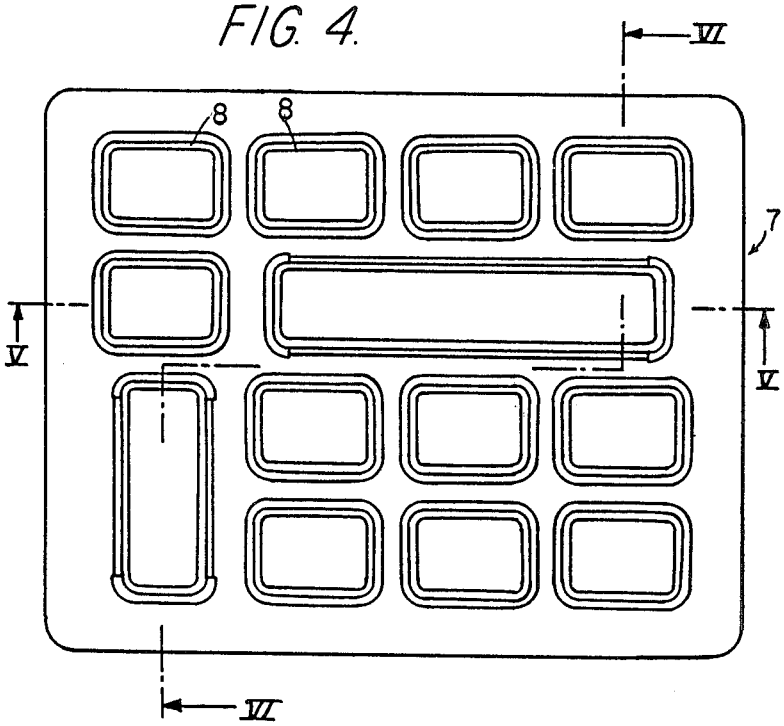
FIG. 4 illustrates a plan view of a sheet of bearing keys according to the invention.

FIGS. 4, 5 and 6 illustrate a sheet 7 also formed by molding of silicone and which comprises a plurality of bearing keys 8.

The keys 8 have different lengths and project from the sheet 7 through blisters 9. The inside of keys 8 are provided with at least one housing 10 in a shape corresponding to that of the stubs 4 of the contactors 2. Blisters 9 include an oblique portion 9', which corresponds to an oblique portion 3' of blister 3 of sheet 1.

Figure 8:
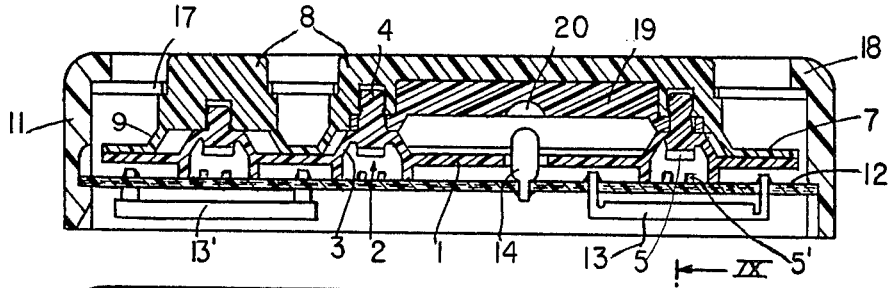
FIGS. 8 and 9 illustrate cross-sectional views taken, respectively, along lines VIII—VIII and IX—IX of FIG. 7.
Figure 7:
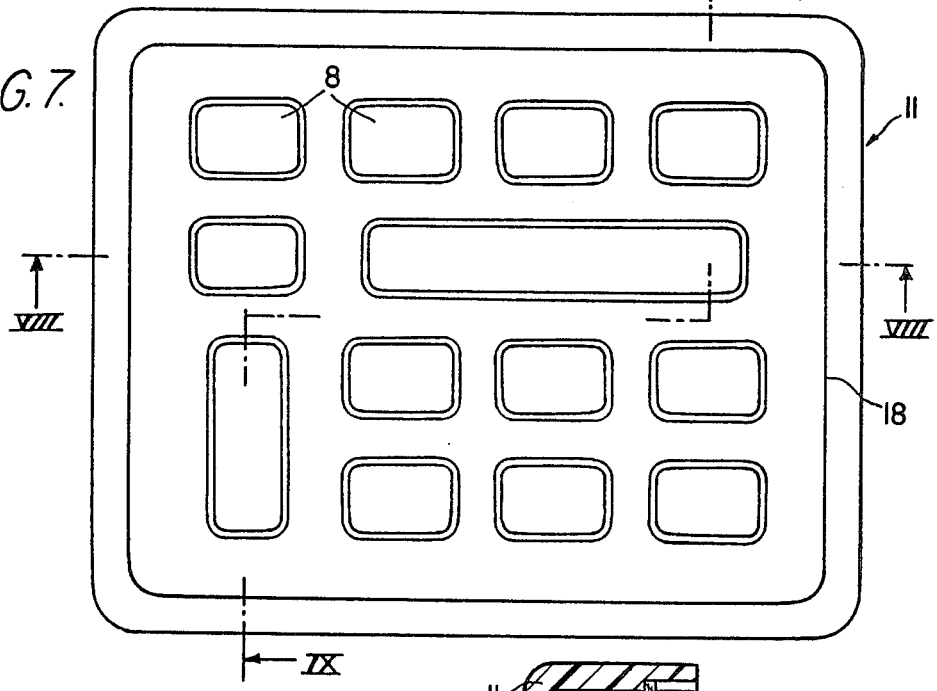
FIG. 7 illustrates a plan view of a control box provided with a keyboard according to the invention.
Figure 9:
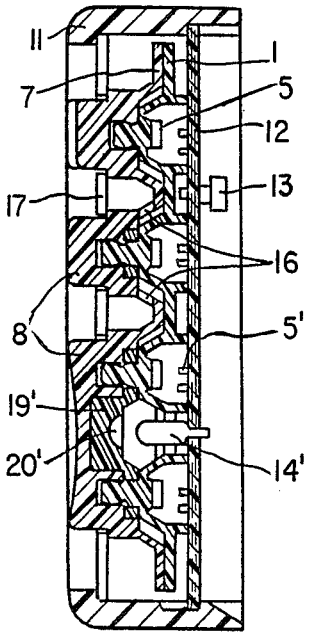

FIGS. 7, 8 and 9 illustrate a control box 11 in which the keyboard of the invention is mounted.

In box 11 a printed circuit 12 is positioned in a traditional manner and is provided with electronic components 13, 13'.

As more specifically illustrated in FIGS. 8 and 9, sheet 1 of contactors and sheet 7 of keys are integrally attached by force fitting of stubs 4 of the contactors in housings 10 of the keys.

The two integral sheets 1 and 7 rest on printed circuit 12 by projections 6 in such a manner that there exists a space between printed circuit 12 and the sheets.

The Figures also permit one to understand the simple manufacturing procedure of the present invention.

The process comprises the steps of producing by molding, sheets 1 and 7 illustrated in the figures, superimposing the sheets and integrally attaching the sheets as illustrated in FIGS. 8 and 9.

It is clear that the adjustment and arrangement of the contactors and the keys are positioned so that the stubs 4 of the contactors face the housings 10 of the keys.

It is important to note that if blisters 3 of the contactors 2 act as a spring so as to cause the contactors to return to their initial position after depression of the keys, the blisters 9 are simply supple and adapted to allow the sheet of keys to deform itself so that the keys accompany the contactors. During operation, when a pressure is applied on the keys, contact pad 5 contacts a corresponding portion 5' of the printed circuit board.

As illustrated in FIGS. 8 and 9, luminescent diodes 14 and 14' are arranged in the printed circuit 12 and traverse the perforations 15, 15' provided in the sheet 1 of the contactors.

In this embodiment, the diodes 14 and 14' are provided under the long keys with several contactors and such that the diodes are positioned between the contactors 2 of the key.

These keys have on the large sides of their blisters 9 perforations as can be seen at reference numeral 16 of FIGS. 6 and 9.

As illustrated in FIGS. 8 and 9 sheets 1 and 7 have peripheral edges which are positioned at a distance from box 11.

Moreover, a small translucent plate 17, illustrated in FIGS. 8 and 9, is fitted in box 11.

The small plate 17 has perforations corresponding to keys 8 which traverse the perforations. As illustrated in FIGS. 7–9 this small plate 19 rests on an edge 18 of the box and shoulders of the keys abut on the small plate.

As also illustrated in FIGS. 8 and 9, reinforcements such as inserts 19 and 19' made of polyamide for example, are provided for at least the keys controlling several contactors.

The reinforcements 19 and 19' have perforations adapted to be traversed by the stubs 4 of the contactors 2 of the relevant keys and can also be provided with a groove 20, 20' to accommodate diodes 14, 14' when these keys are pressed.

It is clear that with such an embodiment the light emitted from diodes 14, 14' can be diffused under the keys, between the contactors 2 and through the perforations 16 of the blisters 9. Moreover, the light can also be diffused over the entire keyboard by means of the space between the sheet 1 and the printed circuit 12, and the space between the sheets 1, 7 and the box 11.

The invention is not limited to the embodiment described above.

Thus, it is within the scope of the invention for keys 8 not to be a part of the sheet 7 but to be individually arranged.

Further, although projections 6 allow a diffusion of the light of the diodes 14, 14', the latter are not compulsory.

The diodes can, moreover, be positioned under the simple keys, in which case sheet 1 and the keys can be transluscent, or the diodes can even be positioned between two keys.

In addition, reinforcement 19, 19' can also be provided for simple keys.

Also, the keys with several contactors can simply rest upon certain contactors among them, the latter then not having stubs 4.

Finally, the keyboard shown in FIGS. 7–9 is given by way of example and numerous arrangements can be conceived within the scope of the invention, such as their use in calculators and telephones.

I claim:

1. A keyboard for a control box of an electrical apparatus comprising:

(a) a first sheet comprising:

(i) a plurality of contactors, wherein each of said contactors comprises an elastically deformable blister projecting from said first sheet to function as a spring; and (ii) a plurality of contact pads positioned within said blisters; and (b) a second sheet comprising a plurality of keys, each having a housing therein, wherein said plurality of contact pads comprise means for contacting a printed circuit in response to a pressure applied on said plurality of keys, wherein at least one of said plurality of contactors comprises a stub positioned atop of said contactor opposite from said contact pads, and wherein said at least one stub comprises means for being force fitted into said housing of one of said plurality of keys.

2. The keyboard defined by claim 1, wherein said printed circuit is mounted on a printed circuit board.

3. The keyboard defined by claim 2, wherein said first sheet further comprises a plurality of projections each comprising means for contacting said printed circuit board and spacing said contactors from said printed circuit.

4. The keyboard defined by claim 3, wherein each of said contact pads is adapted to be displaced along a displacement axis, wherein said projections are coaxially positioned to said contact pads.

5. The keyboard defined by claim 3, wherein said first sheet and said second sheet are spaced from the edges of a control box, wherein said printed circuit board comprises at least one luminescent diode positioned thereon within said control box such that the light emitted by said at least one diode first traverses the space between said printed circuit board and said contactors, and then traverses the space defined by oblique portions of said first and second sheets, and the space defined by said plurality of keys and said edges of said control box.

6. The keyboard defined by claim 5 wherein said at least one diode is positioned between said contactors.

7. The keyboard defined by claim 5 wherein said at least one diode is positioned between said keys.

8. The keyboard defined by claim 5 further comprising a plurality of luminescent diodes.

9. The keyboard defined by claim 5, wherein said at least one diode extends through a perforation in said first sheet.

10. The keyboard defined by claim 1, wherein said second sheet covers said first sheet, wherein each key comprises a supple blister projecting from said second sheet, wherein at least one supple blister covers at least one elastically deformable blister of said first sheet.

11. The keyboard defined by claim 10 wherein said at least one supple blister covers a plurality of elastically deformable blisters on said first sheet.

12. The keyboard defined by claim 10, wherein each of said first and second sheets is formed of a non-conducting silicone, and each of said contact pads is formed of a conducting silicone.

13. The keyboard defined by claim 4, wherein at least one key controls a plurality of contactors, wherein at least one of said keys comprises a perforation therein arranged on a supple blister corresponding to said at least one of said keys.

14. The keyboard defined by claim 13, wherein said perforation is positioned so as to permit light to pass therethrough from a luminescent diode extending through said first sheet and positioned on a printed circuit board under said at least one key and between said plurality of contactors controlled by said at least one key.

15. The keyboard defined by claim 1 further comprising a translucent plate having a plurality of perforations therein through which said plurality of keys extend.

16. The keyboard defined by claim 1, wherein each said first sheet and said second sheet are made of a supple material, wherein at least one of said plurality of keys comprises at least one plastic reinforcement positioned in said housing of said at least one plurality of keys.

17. The keyboard defined by claim 16, wherein each of said keys comprises said at least one plastic reinforcement.

18. The keyboard defined by claim 16 wherein said at least one plurality of keys comprises a plurality of plastic reinforcements.

* * * * *